US005722353A

United States Patent [19]

Phelps

[11] Patent Number: 5,722,353

[45] Date of Patent: Mar. 3, 1998

[54] ONCE-THROUGH STEAM GENERATOR VERTICAL TUBE HOPPER ENCLOSURE WITH CONTINOUS TRANSITION TO SPIRAL FURNACE ENCLOSURE

[75] Inventor: Calvin E. Phelps, Akron, Ohio

[73] Assignee: The Babcock & Wilcox Company, New Orleans, La.

[21] Appl. No.: 435,097

[22] Filed: May 4, 1995

[51] Int. Cl.[6] ..... F22B 37/00

[52] U.S. Cl. ..... 122/6 A; 122/235.11; 122/235.12; 122/235.24; 122/235.25; 122/406.4; 122/511

[58] Field of Search ..... 122/235.11, 235.12, 122/235.14, 235.15, 235.22, 235.24, 235.25, 406.4, 6 A, 511

[56] References Cited

U.S. PATENT DOCUMENTS

| | | | |
|---|---|---|---|
| 4,465,023 | 8/1984 | Wagner | 122/6 A |
| 4,704,992 | 11/1987 | Waryasz | 122/235.12 |
| 5,201,282 | 4/1993 | Albrecht | 122/6 A |
| 5,560,322 | 10/1996 | Fitzgerald | 122/6 A |

*Primary Examiner*—Henry A. Bennett
*Assistant Examiner*—Jiping Lu
*Attorney, Agent, or Firm*—Daniel S. Kalka; Robert J. Edwards

[57] ABSTRACT

A once-through steam generator having single pass non-split fluid flow circuitry with a one to one connection of furnace hopper vertical tubes assembly being connected to the spiral tubes of the lower furnace assembly.

4 Claims, 3 Drawing Sheets

ONCE-THROUGH STEAM GENERATOR VERTICAL TUBE HOPPER ENCLOSURE WITH CONTINOUS TRANSITION TO SPIRAL FURNACE ENCLOSURE

BACKGROUND OF THE INVENTION

1. Field of Invention

The present invention relates to steam generators in general and in particular to such steam generators of the Once-Through or "Benson" type also known as the Universal-Pressure boilers which have spiral and vertical flow circuitry and hopper coils.

2. Description of the Related Art

The Universal-Pressure boiler or the Once-Through boiler, derives its name from the fact that it is applicable functionally at all commercial temperatures and pressures, subcritical and supercritical. Economically, it is applicable to the larger sizes, to the higher subcritical pressure ranges, and to the supercritical pressure ranges. Numerically the boiler parameters and operating conditions are as follows:

Range in capacity, steam output about 300,000 lb/hr to an undetermined maximum exceeding 10,000,000 lb/hr.

Operating pressure subcritical, usually at 2400 psi throttle pressure, and supercritical, usually at 3500 psi throttle pressure with 5% over-pressure.

Steam and reheat temperatures as required, usually 1000 F. Constant steam temperature can be maintained to minimum once-through load with any fuel. Constant reheat temperature can be maintained to an intermediate load with any fuel, including coal, oil or natural gas.

Operational control is completely automatic, including pumping and firing-rate control and steam temperature control.

The furnace may be water-and/or steam-cooled; pressure or balanced-draft type.

The principle of operation is that of the once-through or "Benson" cycle. The working fluid is pumped into the unit as liquid, passes sequentially through all the pressure-part heating surfaces, where it is converted to steam as it absorbs heat, and leaves as steam at the desired temperature. There is no recirculation of water within the unit and, for this reason, a drum is not required to separate water from steam.

Firing may be of oil, gas or coal, the last either in pulverized form or crushed for cyclone furnace firing. The furnace is completely fluid cooled. It may be designed for balanced draft or pressure operation. Ash removal may be either dry or wet. Reheaters for single or two-stage reheat may be incorporated in the design for the reheat cycle.

The Universal-Pressure boiler is designed to maintain a minimum flow inside the furnace circuits to prevent overheating of furnace tubes during all operating conditions. This flow must be established before start-up of the boiler. A bypass system, integral with the boiler, turbine, condensate and feedwater system, is provided so that the minimum design flow can be maintained through pressure parts which are exposed to high temperature combustion gases during the start-up operations and at other times when the required minimum flow exceeds the turbine steam demand.

The bypass system performs the following additional functions:

1. Controls the pressure and temperature of the steam leaving the boiler during start-up and shutdown to conditions suitable for the turbine, condenser and auxiliary equipment.

2. Provides means for recovering heat flowing to the bypass system, during start-up and low-load operations, utilizing the feedwater heaters.

3. Provides means for conditioning the water during start-up without delaying boiler and turbine warming operations.

4. Protects the high temperature (secondary) super-heater against shock from water during start-up.

5. Provides means for relieving excessive pressure in the system after a load trip.

Once-through steam generators designed with furnace variable operating pressure are generally equipped with spiral lower furnace tube and membrane enclosures to minimize heat absorption differences from tube to tube that cause flow imbalances and material damage to the furnace. The fluid in each spiral tube absorbs about the same amount of heat since each tube is wrapped around the furnace perimeter and is routed through similar heat input zones. Prior art normally included spiral furnace hoppers with the spiral furnaces because of the complex circuitry and economic costs associated with transitioning vertical tubes to a lesser number of spiral tubes. Prior art also includes vertical tube hopper construction for spiral furnaces, but with a fluid mix transition. Prior art further includes vertical tube enclosures forming the complete furnace from the lower hopper inlet to the roof that has been designed for variable operating pressure in the furnace, but these enclosure constructions have not been accepted worldwide as service for variable operating pressure.

The furnace hopper enclosure is not located in the high heat input zones as compared to burner zone furnace enclosure. Therefore, spiral hopper construction is not technically considered to be required construction to minimize flow imbalances from heat upsets or heat absorption differences.

Spiral furnace enclosure inherently requires a lesser number of tubes than a vertical tube furnace enclosure. If the same number of vertical tubes is used as designed for the spiral tubes, the vertical tube centerlines would be too widely spaced for membrane plate to be adequately cooled by heat transfer to the fluid flowing in the tubes. If the hopper enclosure is designed with a sufficient number of vertical tubes as required for adequate cooling of the membrane plate welded between the tubes, a transition must be designed to distribute the flow from one number of vertical hopper tubes to a lesser number of spiral tubes. This type of transition is a costly economic consideration.

Some manufacturers have equipped the spiral furnace with a vertical tube hopper that transitions to the spiral furnace tube enclosure near the hopper upper workpoint elevation. The transition includes distribution of fluid from one number of vertical hopper tubes to a lesser number of spiral furnace tubes through a fluid mix system. The two circuitry mix enclosure at this elevation is seal welded. These manufacturers have publicized that a spiral hopper for solid fuel firing will inhibit the flow of slag to the ash hopper as compared to a vertical tube type construction. Other manufacturers are not as concerned that the spiral hopper inhibits the flow of slag to the ash hopper.

It is seen that none of the prior art designs offer a design where the vertical tube hopper and the spiral furnace are designed with the same number of tubes to eliminate the need for a fluid mixing or redistribution system.

SUMMARY OF THE INVENTION

The present invention is directed to solving the problems associated with prior art flow circuits as well as others by providing a single pass, non-split fluid flow circuit for a once-through steam generator having the lower furnace spiral tubes equal in number to the upper furnace vertical tubes for variable furnace pressure operation to eliminate any fluid mixing or redistribution. To accomplish this aim the upper and lower furnace sections are designed with the same number of tubes so that the fluid flow paths can be connected on a one to one basis through a transition zone of the generator without splitting the flow from any spiral tube as it passes to the upper furnace vertical tubes. Thus no headers, bottles, bifurcates, trifurcates, or other fittings are required to construct a welded mix transition.

The enclosure circuitry forming the four hopper walls are angled at the same angle with respect to vertical direction to allow the perimeter dimensions to be reduced at a higher elevation so that vertical tube construction will be adequate for heat transfer conditions.

In view of the foregoing it will be seen that one aspect of the present invention is to provide a less costly and more reliable flow circuitry for a once-through steam generator having the same number of tubes in the spiral to vertical tube flow circuitry.

Another aspect of the present invention is to provide flow circuitry for a once-through steam generator which will not require fluid mix or flow redistribution circuitry.

These and other aspects of the present invention will be more fully understood upon a review of the following description of the preferred embodiment when considered with the accompanying drawing.

DESCRIPTION OF THE PREFERRED EMBODIMENT

The present description is intended to disclose the preferred embodiment of the present invention but is not intended to limit it thereto.

Figure 1:
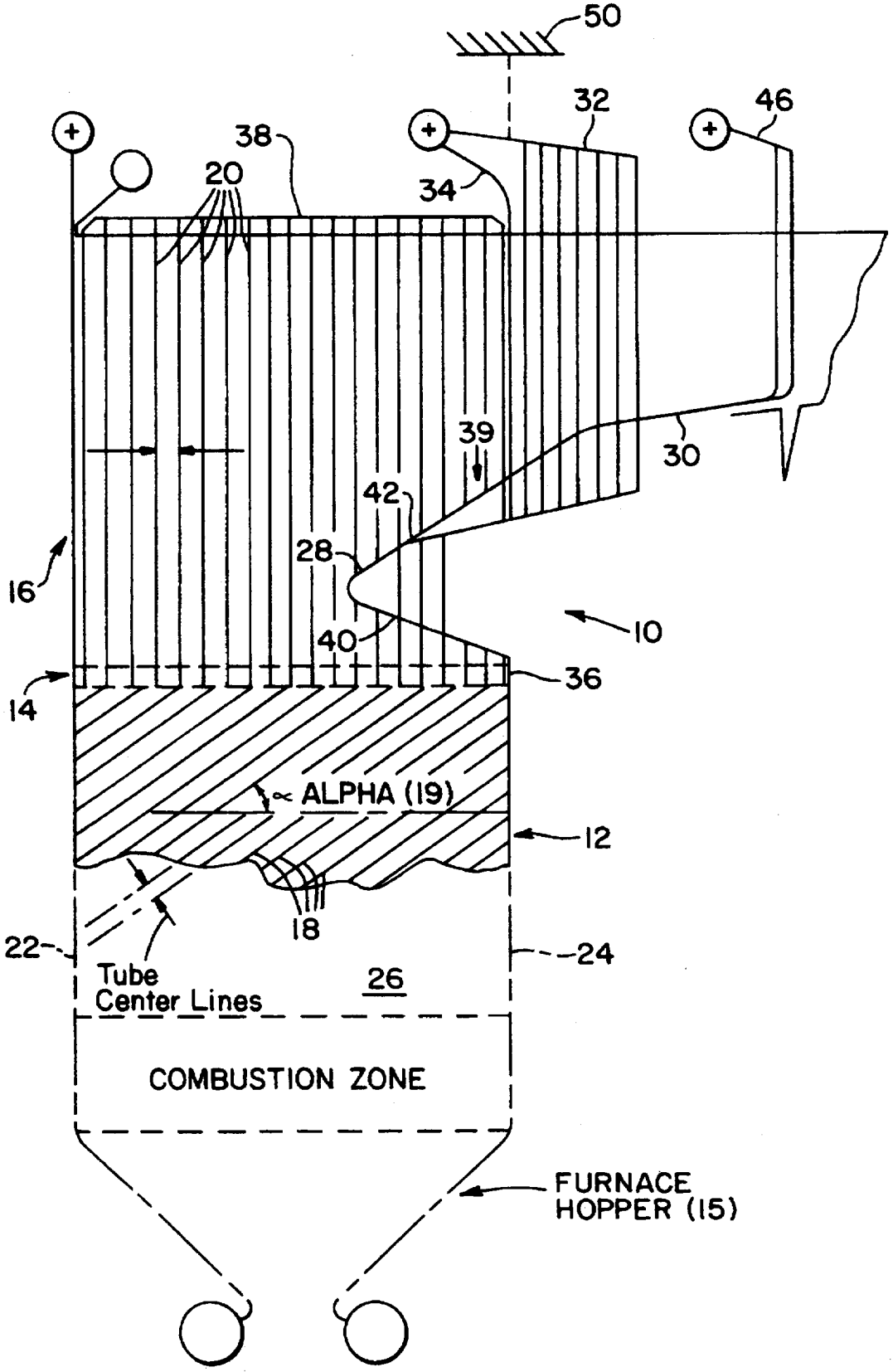
FIG. 1 illustrates a once-through steam generator.

FIG. 1 of the drawings depicts a once-through steam generator assembly 10 which is known as a Universal-Pressure boiler. The Universal-Pressure boiler is a high-capacity, high-temperature boiler of the "Benson" type that is functionally applicable at any boiler pressure. Firing may be by coal, either pulverized or Cyclone-Furnace-fired or by natural gas or oil.

The working fluid is pumped into the unit as liquid, passes sequentially through all the pressure-part heating surfaces, where it is converted to steam as it absorbs heat, and leaves as steam at the desired temperature. There is no recirculation of water within the unit and, for this reason, a drum is not required to separate water from steam. The Universal-Pressure boiler may be designed to operate at either sub-critical or supercritical pressures.

The assembly 10 may be a unit complete in itself without auxiliary heat absorbing equipment, or it may constitute a rather small part of a large steam generating complex in which the steam is generated primarily in the furnace tubes, and the convection surface consists of a superheater, reheater, economizer and air heater. In the latter case, a drum-type boiler comprises only the steam drum and the screen tubes between the furnace and the superheater. However, the furnace water-wall tubes, and usually a number of side-wall and support tubes in the convection portion of the unit, discharge steam into the drum and therefore effectively form a part of the boiler.

Figure 2:
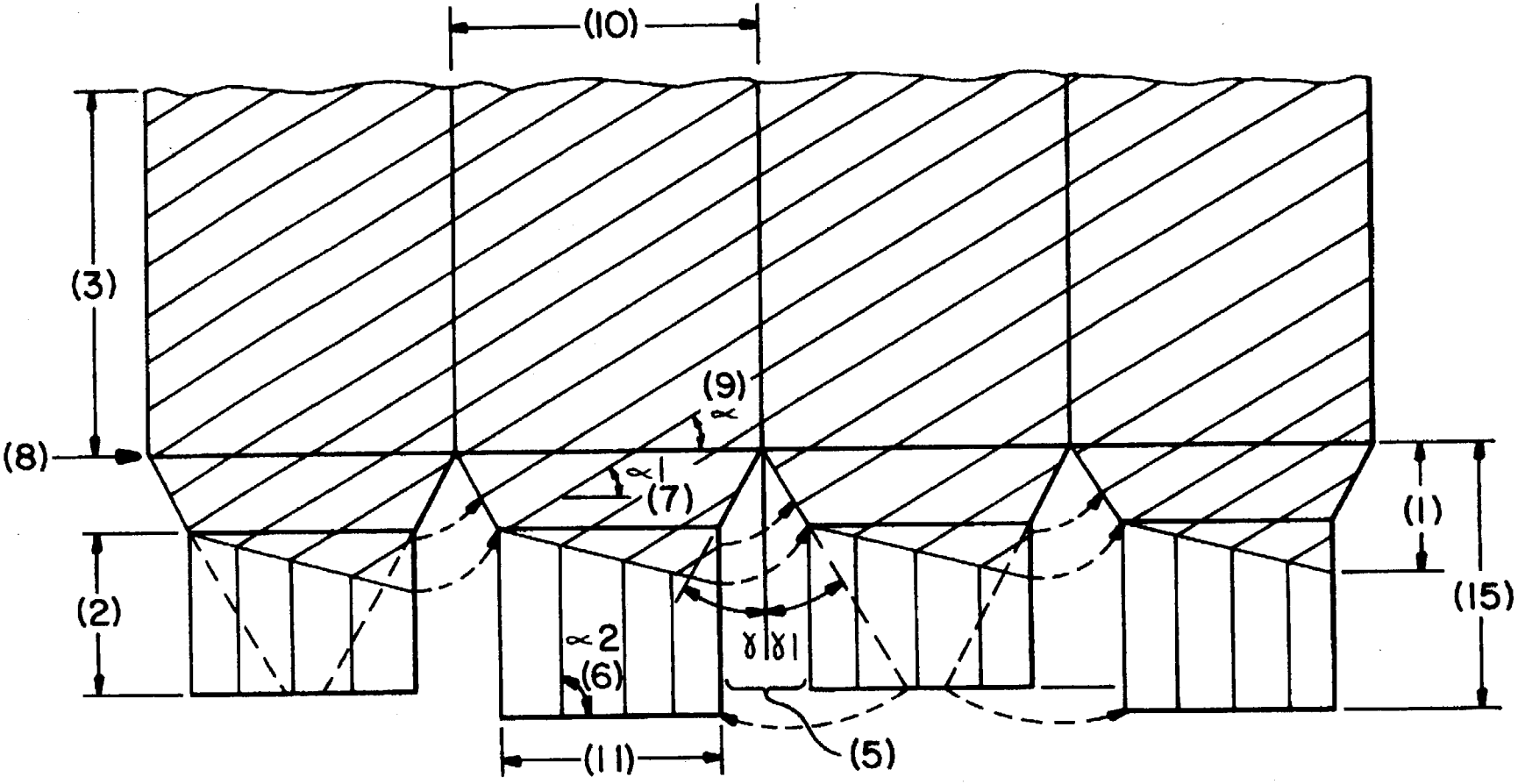
FIG. 2 shows a fold out of the vertical tube hopper and spiral furnace construction for the once-through steam generator of the present invention.
Figure 3:
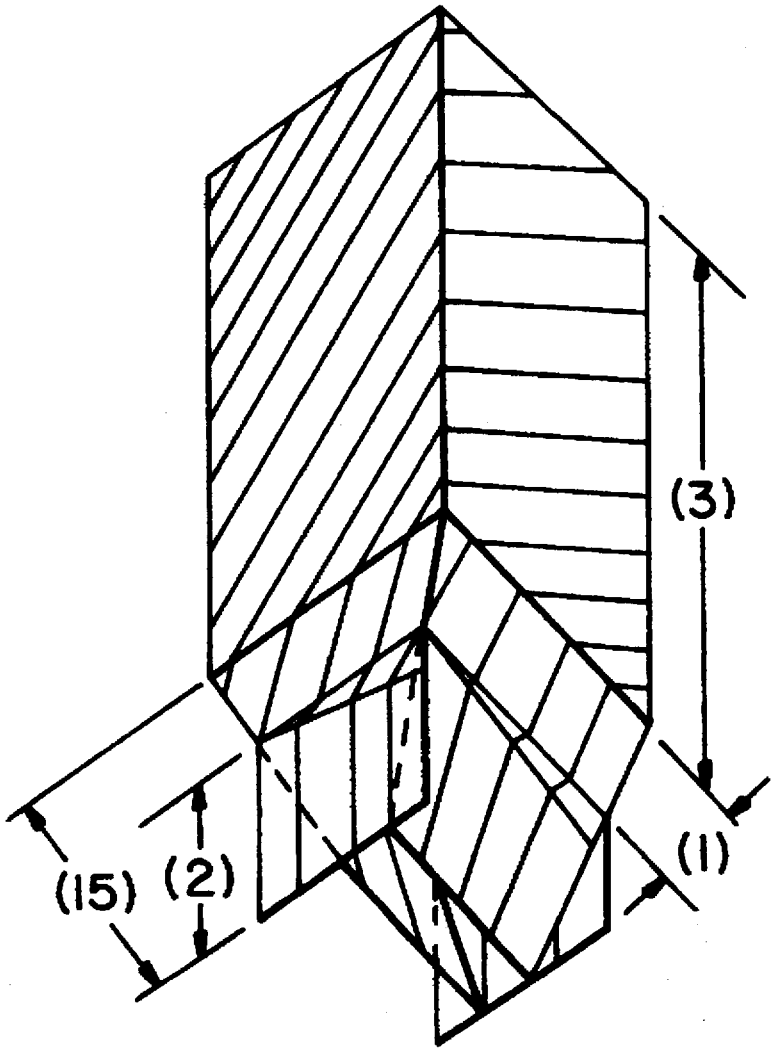
FIG. 3 is an isometric view of the invention shown in FIG. 2.

In the case of the Universal-Pressure boiler, there is no steam drum, but rather an arrangement of tubes in which steam is generated and superheated. As best seen in FIG. 1 the lower zone 12 has a series of spiral tubes extending around the circumference which are connected on a one-to one basis through a transition zone 14 to a series of vertical tubes in the upper zone 16. As is best seen in FIGS. 2 and 3, the lower part of the spiral tubes are connected to a furnace hopper 15. Whether the boiler is a drum or a once-through type, whether it is an individual unit or a small part of a large complex, it is necessary in design to give proper consideration to the performance required from the total complex.

With particular reference to FIG. 1 it will be seen that in the single pass, non-split fluid circuitry of the present invention the lower furnace spiral tubes (18) connect to the upper furnace vertical tubes (20) in a once-through steam generator designed for variable furnace pressure operation. The upper and lower furnace (12, 16) is designed with the same number of tubes. By using known technological design information, the fluid flow paths are connected on a one to one basis through the transition zone (14) without splitting flow from any spiral tube as it passes to the upper furnace (16). intermediate headers, bottles, bifurcates, trifurcates, or other fittings are thus not required.

Since all adjoining parts operate at nearly the same temperature because there is no splitting of flow which resulted in different temperature gradients in the split tubing of the prior art devices, the circuitry forming the membrane tube enclosure for the furnace front, rear, and side walls (22, 24, 26), arch (28), pendent convection pass floor (30), and pendent convection pass front sidewall panels (32) are made of all welded, flue gas tight construction, including the front screen tube (34) penetrations.

The present flow circuitry is not susceptible to corrosion from water remaining in the flow circuit during any drainage of the circuitry during a shut down of the generator. To understand this feature, one is referred to the heavy line circuitry from the spiral furnace termination (36) on the rear wall (24) to the arch (28) since multiple downstream components in the upper furnace area are all supplied in parallel without splitting the fluid flow from any spiral furnace tube and without forming any horizontal non-drainable water pocket. The upper furnace (16) front and sidewalls are constructed vertically upwards to complete these walls without the complications of supplying other downstream components before flowing to their respective outlet headers (38).

The design heat absorption rate is approximately one-third at the upper arch location (42) as the underside (40) of the arch (28) which is fully exposed to furnace radiation. This allows the tube centerlines to be increased significantly on top of the arch (28). This permits sufficient tubes to be routed outside the setting at location (42) to construct the front screen tube (34) and the pendent convection pass front sidewall (32) membrane panels. The arch tube circuit downstream of the arch (28) is constructed by bending tubes and installing closure plates to seal weld openings left by the rerouted tubes and designing the remaining arch circuit and pendent convection pass floor (30) to increase membrane tube centerlines. Rear screen tubes (46) are constructed as a continuation of the pendent convection pass floor (30). The furnace rear wall (24) dead loads are supported through mechanical linkages to the front screen tubes (34) and to boiler top supports (50).

Turning now to FIG. 2. and 3, it is seen that the lower hopper enclosure is arranged in a vertical tube configuration (2) as shown by 90 degree angle, alpha 2 (6). By design, this invention transitions from a vertical tube enclosure (2) to spiral tube enclosure within the hopper transition area (1). The angle of inclination from horizontal, alpha 1 (7), for the hopper spiral tubing is designed so that the membrane closure plate material will not be overheated by inadequate heat transfer to the fluid flowing in the tubes. At the hopper upper workpoint (8), the spiral tube angle of inclination from horizontal, alpha (9), suits the spiral furnace design (3). The four walls of the spiral hopper transition (1) are sloped the same with respect to vertical (5) for perimeter dimension considerations, and so that extra bends are not required within the transition enclosure (1) to match tube ends as a tube routes from one wall to the next wall around a corner. In the prior art, the hopper walls were sloped differently with respect to vertical (5), and bends were included within the enclosure to match tube ends from wall to wall around the corners. Eliminating these bends is an economic consideration. Another economic benefit for the new transition (1) is that the furnace ash hopper width is reduced and it will not be sized for the full furnace width dimension (10), but it will be sized for the width dimension at (11).

Certain modification and improvements will occur to those skilled in the art upon reading this description. It will be understood that such modifications and improvements have been deleted herein for the sake of conciseness and readability but are included in the scope of the following claims.

What is claimed is:

1. In a once-through steam generator having a fluid flow circuitry that includes furnace front, rear, and side walls, the improvement comprising:

a series of spiral tubes extending around a lower furnace area of the steam generator;

a series of vertical hopper tubes located in the lower furnace area of the steam generator and below said series of spiral tube; and said series of vertical hopper tubes being connected on a one to one basis to said series of spiral tubes in an all welded, flue gas tight construction to prevent any fluid flow splits, said vertical hopper tubes being equal in number to said spiral tubes.

2. A generator as set forth in claim 1, further comprising a series of vertical tubes connected on a one to one basis to said series of spiral tubes through connections in a transition zone of the generator between the lower furnace area and an upper furnace area.

3. A generator as set forth in claim 1, further comprising a series of vertical pendant tubes in a convection pass of the steam generator connected on a one to one basis to said spiral tubes to provide a single pass fluid flow.

4. A generator as set forth in claim 3, further comprising a series of screen tubes in the convection pass of the steam generator connected on a one to one basis to said spiral tubes to provide a single pass fluid flow.

* * * * *